US011185145B1

(12) United States Patent
Zheng et al.

(10) Patent No.: US 11,185,145 B1
(45) Date of Patent: Nov. 30, 2021

(54) COSMETIC APPLICATOR

(71) Applicant: APR Beauty Group Inc., Toronto (CA)

(72) Inventors: Min-Yan Zheng, Richmond Hill (CA); Feng-ying Fu, Markham (CA); Jun Shen, New Westminster (CA)

(73) Assignee: APR Beauty Group Inc., Toronto (CA)

( * ) Notice: Subject to any disclaimer, the term of this patent is extended or adjusted under 35 U.S.C. 154(b) by 0 days.

(21) Appl. No.: 17/028,771

(22) Filed: Sep. 22, 2020

(51) Int. Cl.
*A45D 34/04* (2006.01)
*A45D 40/26* (2006.01)
*A45D 33/00* (2006.01)

(52) U.S. Cl.
CPC ..... *A45D 34/046* (2013.01); *A45D 33/00* (2013.01); *A45D 40/267* (2013.01); *A45D 34/045* (2013.01); *A45D 40/265* (2013.01); *A45D 2033/001* (2013.01); *A45D 2200/1018* (2013.01)

(58) Field of Classification Search
CPC ..... A45D 33/00; A45D 2200/1018; A45D 2033/001; A45D 34/045; A45D 34/046; A45D 40/265; A45D 40/267; A45D 34/00; A45D 34/04; A45D 40/26
USPC ..... 401/126–130; 15/160; 132/317
See application file for complete search history.

(56) References Cited

U.S. PATENT DOCUMENTS 6,280,112 B1 * 8/2001 Vieu ..... A45D 34/042 401/122
6,331,085 B1 * 12/2001 Schrepf ..... A45D 34/046 401/122
2004/0161285 A1 * 8/2004 Gueret ..... A45D 34/04 401/130
2015/0201737 A1 * 7/2015 Roualdes ..... A45D 40/265 132/200

* cited by examiner

*Primary Examiner* — David J Walczak

(57) ABSTRACT

A cosmetic applicator for applying a composition including a cosmetic, care or pharmaceutical composition onto the keratinous substrate. The cosmetic applicator further comprises an applicator head, a stem and a closure. The applicator head includes an applying member which comprises a support body extending in along a central longitudinal axis of the applying member. The support body is curved along the central longitudinal axis and includes a first application face and a second application face opposing the first application surface. The first application face and a second application face are bounded by two lateral edges. The support body of the applying member comprises a recessed region formed at a distal portion of the first application face and a hollow region formed at a proximal portion of the second application face.

20 Claims, 6 Drawing Sheets

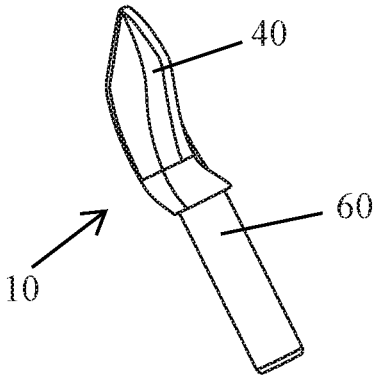
FIG. 3
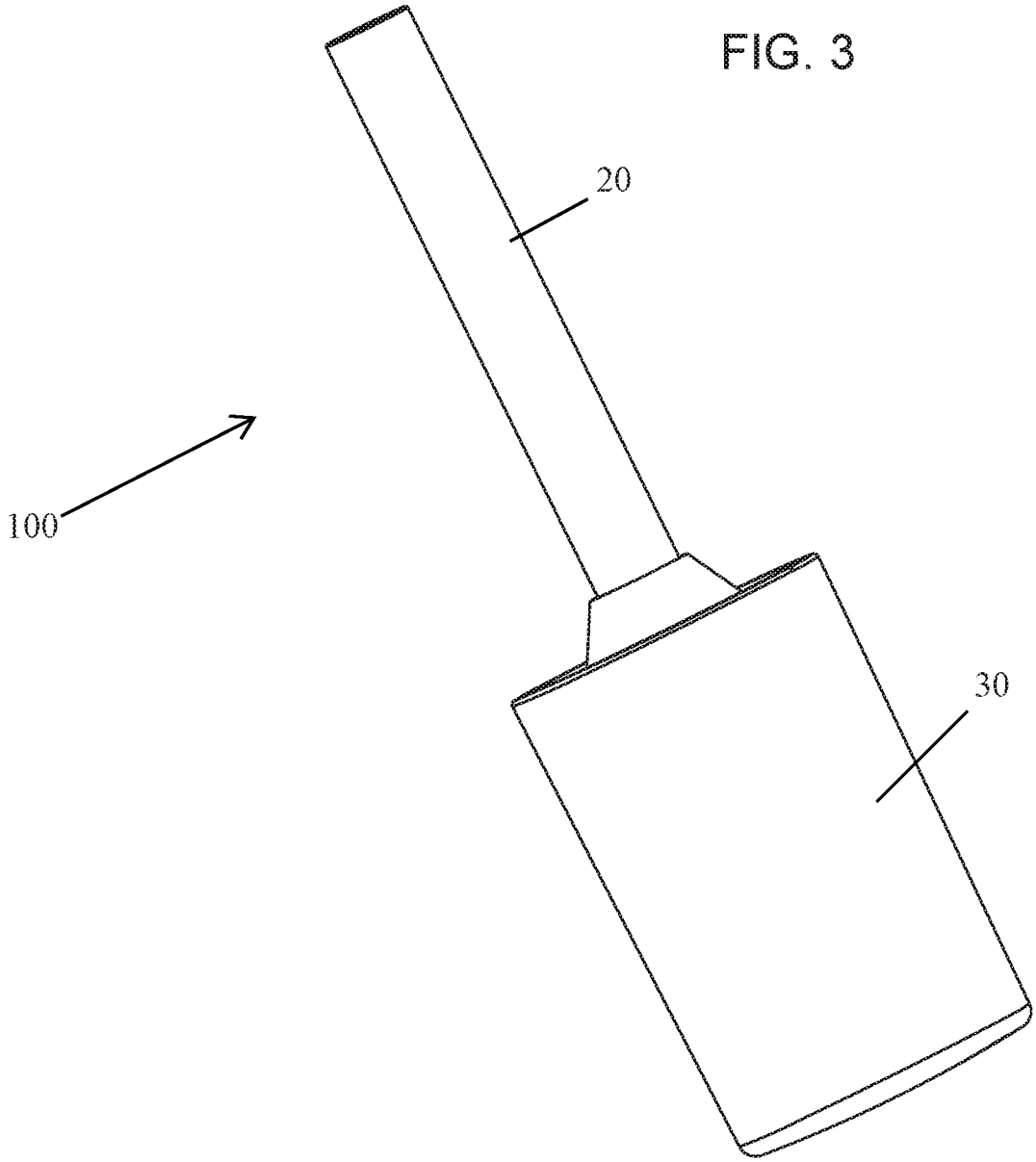

COSMETIC APPLICATOR

BACKGROUND

Field of the Invention

The Embodiments of the present disclosure generally relate to a cosmetic applicator for applying a product including a cosmetic, care or pharmaceutical product onto human skin or keratinous substrate, such as, for example, lips, hair, eyebrows, nails and/or eyelashes, cheeks etc. The product includes viscous liquid, pasty, powdery or semi soft product for application on skin of face, eyes, lips etc.

Description of the Related Art

Many cosmetic products that are flowable or otherwise non-self-sustaining in shape are packaged and sold in containers which hold the cosmetic products and from which the cosmetic products are transported and applied to user's skin by cosmetic applicators. Commonly, the cosmetic applicator is provided at the end of a stem carried by a cap which seats on and closes the mouth or opening of the container, the cosmetic applicator being immersed in the container body of cosmetic material when the cap is in the container-closing position. The cap serves as a handle for the user when the applicator, bearing a quantity of the cosmetic product, is withdrawn from the container and applied to the skin.

In some instances, a flexible elastomeric wiper is mounted in the container opening so as to engage the cosmetic applicator as the applicator is withdrawn through the opening, for removing excess cosmetic material that may be carried by the cosmetic applicator from the body of material within the container.

Such cosmetics applicators are required to deposit a large amount of cosmetic product during each application process. The conventional applicators, in which the cosmetic product to be applied is in each case only stored by adhesion to the applicator surface, have to be dipped into the cosmetics container repeatedly and newly charged in this manner several times in a row in order to carry out an entire application process. This bothers many users.

Another attempt to provide a remedy for this is represented by the concept of an internally supplied applicator, in which a product connection is established between the actual applicator portion, by means of which the application is performed and the cosmetic container in such a way that only little pressure has to be exerted on the container during application in order to dispense more product on the applicator. Thus, the applicator can be recharged without having to put it down and dip it into the cosmetic container again.

There still exists a need for an applicator having surfaces with which a larger amount of the cosmetic product can be applied without having to re-dip the applicator into the cosmetic container.

SUMMARY

It is an object of present disclosure to provide a cosmetic package that can be easily configured to contain a cosmetic product and a cosmetic applicator.

It is an object of present disclosure to provide a cosmetic package having a cosmetic applicator with which a larger amount of a cosmetic product can be applied without having to dip the cosmetic applicator into the cosmetic container occasionally.

It is an object of present disclosure to provide a cosmetic applicator which offers a comparatively large surface area, very simple to use, economical to manufacture and aesthetically pleasing.

It is an object of the present disclosure is to provide a combined cosmetics package that comprises separable components that fit securely together so as to make a unitary package.

Further, a cosmetic applicator is desired which is comfortable and easier to use.

Accordingly, there is provided a cosmetic package comprising a receptacle for holding a product and a cosmetic applicator. The cosmetic applicator comprises an applicator head, a stem, and a cap. The applicator head further comprises an applying member having a support body which is curved along a central longitudinal axis of the applicator head. The support member comprises a first application face and a second application face which opposes the first application face. The first application face and a second application face are bounded by two lateral edges. The support body of the applying member comprises a recessed region formed at a distal portion of the first application face and a hollow region formed at a proximal portion of the second application face that allow a large amount of product to be stored on both the first and second application faces.

Further, the applicator head of the cosmetic applicator may be used to apply the product including a cosmetic or care product. The cosmetic or care product includes viscous cosmetics, mascara, eyebrow powder, lip gloss, hair color, skin care, under eye cosmetics, pharmaceutical and like products.

According to an aspect of the present disclosure, the cap of the cosmetic applicator has threads which can be screwed onto threads formed on a neck of the receptacle. The applicator head is retained at a distal end of the stem for applying the product; and the cap at a proximal end of the stem.

According to an aspect of the present disclosure, in the neck of the receptacle there is provided a wiper for wiping off excess product from the cosmetic applicator.

The applying member further comprises a shank portion that is retained at the distal end of the stem for applying the cosmetic product; and the cap is retained at the proximal end of the stem. The distal end of the stem includes an interior longitudinal cavity for receiving and retaining the applicator head.

According to another aspect of the present disclosure, the central longitudinal axis of the applicator head, the applying member and the stem are the same as they extend in the same longitudinal axis. Further, the applying member comprises a body extending along the central longitudinal axis of the cosmetic applicator. The support body is made of a substantially flat body along a major portion of its length. The applying member has a longitudinal shape in a direction of the longitudinal axis in which the stem extends, and has a width axis in a direction orthogonal to the longitudinal axis.

Further, the first application face has a convex surface followed by a concave surface when seen from a proximal end to a distal end of the applying member along the central longitudinal axis. The convex surface of the first application face extends along at least 30% of a length of the first application face of the applying member, more preferably at least 50% of the length of the first application face of the applying member. However, in alternate embodiments, the convex surface may extend along less or more than half of the length of the first application face of the applying member.

The first application face is provided with the recessed region which is curved along the width axis. The recessed region extends in the concave surface and partially on the convex surface of the first application face. A width of the recessed region varies along the longitudinal axis. A proximal part of the convex surface of the first application face is convexly curved both in the longitudinal axis and in the width axis, but a distal portion of the convex surface of the first application face is convexly curved in the longitudinal axis but is concavely curved in the width axis due to presence of the recessed region which extends partially therein.

Further, the recessed region is configured to hold a large amount of cosmetic product. When the cosmetic applicator is used, the cosmetic product is held in the recessed region. The recessed region extends along at least 60% of the length of the first application face. However, in alternate embodiments, the recessed region may extend less or more than 60% of the length of the first application face of the applying member.

According to yet another aspect of the present disclosure, the convex surface of the first application face preferably has a larger radius of curvature than a radius of curvature of the concave surface of the first application face when observed in a side view of the applying member.

According to another aspect of the present disclosure, the second application face has a concave surface followed by a convex surface when seen from the proximal end to the distal end of the applying member. Further, the convex surface of the first application face opposes the concave surface of the second application face, and similarly, the concave surface of the first application face opposes the convex surface of the second application face.

According to yet another aspect of the present disclosure, the concave surface extends along more than 30% of a length of the second application face of the applying member, more preferably at least 50% of the length of the second application face of the applying member. However, in alternate embodiments, the concave surface may extend along more or less than half of the length of the second application face of the applying member.

According to yet another aspect of the present disclosure, the support body of the applying member has the hollow region formed by the concave surface of the second application face. The hollow region is configured to hold a large amount of cosmetic product on the second application face. When the cosmetic applicator is used, the cosmetic product is held in the hollow region.

According to yet another aspect of the present disclosure, the concave surface of the second application face preferably has a larger radius of curvature than the convex surface of the second application face in a side view of the applying member. When the cosmetic product is applied to the lips, the concave surface of the second application face uniformly hugs the lips, while providing a sufficient amount of the cosmetic product for application because of the hollow region on the second application face.

According to yet another aspect of the present disclosure, the second application face further comprises a longitudinal rib that extends along at least a major portion of the length of the second application face from the proximal end to the distal end of the applying member. More particularly, the longitudinal rib is formed in the central region in the width axis and is formed over substantially the entire length in the longitudinal axis of the applying member. The longitudinal rib extends both on the concave surface and the convex surface of the second application face. The longitudinal rib is molded with the support body of the applying member, on the second application face.

According to yet another aspect of the present disclosure, the longitudinal rib divides the hollow region into two reservoirs, namely a first reservoir and a second reservoir. The first reservoir lies on a left side of the longitudinal rib while the second reservoir lies on a right side of the longitudinal rib.

According to yet another aspect of the present disclosure, the first reservoir and the second reservoir are symmetrical with respect to each other.

According to yet another aspect of the present disclosure, the longitudinal rib extends up to at least 90% of a length of the applying member on the second application face. In alternate embodiments, the longitudinal rib may extend less or more than 90% of the length of the applying member such that it extends both on the concave surface and the convex surface of the second application face.

According to yet another aspect of the present disclosure, the longitudinal rib has a width which gradually decreases along the longitudinal axis of the applying member from the proximal end towards the distal end of the applying member. At the distal end of the applying member, the longitudinal rib forms a tapered tip.

According to yet another aspect of the present disclosure, the longitudinal rib has a height along the longitudinal axis that varies. Further, an upper surface of the longitudinal rib is curved along the longitudinal axis of the applying member and comprises a concave curve followed by a convex curved when seen from the proximal end to the distal end of the applying member.

According to yet another aspect of the present disclosure, the longitudinal rib has a substantially mountain shape has two inclined surfaces that extend left and right of the longitudinal rib. The inclined surfaces are formed along the longitudinal axis of the longitudinal rib over substantially an entire length of the longitudinal rib. The inclined surfaces each has a concave curved surface capable of holding the cosmetic product. The degree of holding the cosmetic product can be controlled by adjusting the degree of concave curvature of the inclined surfaces. In this case, the degree of curvature of the two curved surfaces of the inclined surfaces may be the same or different.

According to yet another aspect of the present disclosure, the longitudinal rib provides a structural strength to the applying member, so that the applying member does not bend away from the longitudinal axis of the applying member during wiping by the wiper on withdrawal of the applying member from the receptacle. In other words, the longitudinal rib resists the deformation of the applying member away from the longitudinal axis.

According to yet another aspect of the present disclosure, the longitudinal rib has a first longitudinal edge and a second longitudinal edge. The first longitudinal edge and the second longitudinal edge are symmetrical with respect to each other.

The applying member has a widest part when viewed from the front or back. The widest part may be present at any portion of a length of the applying member. In a preferred embodiment, the applying member has the widest part located approximately at ¾th of the length of the applying member near a distal portion of the applying member. In alternate embodiments, the widest part may not be located at ¾th of the length of the applying member.

According to yet another aspect of the present disclosure, when viewed from the front, from the proximal end to the distal end of the applying member, the lateral edges of the applying member move away from the longitudinal axis of the applying member till they reach the widest part of the applying member and then converge toward each other to form a pointed tip at the distal end of the applying member, thus forming a pen nib like shape.

According to yet another aspect of the present disclosure, the support body of the applying member gradually decreases in width from the widest part towards the proximal end of the applying member. Further, the width of the support body of the applying member gradually decreases from the widest part to the distal end of the applying member forming a tapered tip. The tapered tip is preferably a sharply pointed. The sharply pointed tip helps in delicate and fine application of the cosmetic product to, for example, the ends of lips of the user. In short, the applying member has its width gradually increased from the tapered tip to the widest part and gradually decreased from the widest part towards the proximal end.

According to yet another aspect of the present disclosure, a thickness of the support body of the applying member, measured as smallest distance between the first and the second application faces of the support body, reduces along the longitudinal axis of the applying member at least from the proximal end of the applying member up to a middle length of the applying member and is substantially constant from the middle length to up to the distal end of the applying member. Further, thickness of the applying member at any point along its length is maximum at a middle of the applying member.

In alternate embodiments, the thickness of the support body of the applying member may remain constant through the length of the applying member or may vary at any portion of the length of the applying member.

In applying the cosmetic product, the applying member is able to retain an increased quantity of the cosmetic product because of the synergistic effect brought about by the combination of the curvedness and the effect of the flocking finish. As a result, the number of the applying operations is reduced. To cover the applying portion in flocking produces another advantage that the applying portion feels soft when applied to the lips or any other area of skin of the user.

According to an aspect of present disclosure, the applying member has a plane of symmetry along the central longitudinal axis such that a left and right of the applying member are symmetrical from each other in relation to the central longitudinal axis.

According to an embodiment of the present disclosure, an outer surface of the applying member is covered with application element which in this case is flocked fibers. Briefly, the fibers for flocking which may be of any commonly used material, such as nylon, polyester or any natural fiber are applied with an adhesive, such as an epoxy, to the surface to be flocked. The flocking finish to the outer surface of the applying member may be achieved by an appropriately chosen known technique, such as electrostatic flocking. The outer surface of the applying member before being flocked is smooth on its entire surface. That is, the outer surface of the applying member before being flocked has no surface textures, such as a wrinkle finish or a matte finish, over the entire surface thereof. To put it another way, the outer surface of the applying member before being flocked are smooth and slippery. Preferably, the flocking process takes place in an electrostatic field, which results in the proper orientation of the fibers. The flock on the outer surface of the applying member provides a convenient "reservoir" which can hold a small amount of the cosmetic product adequate for one or two applications. In alternate embodiments, the outer of the applying member may include injection molded fibers, projections or grooves which are capable of holding the cosmetic product.

According to an embodiment of the present disclosure, the outer surface of the applying member is covered by a flock coating. However in alternate embodiments, the outer surface of the applying member may not be covered by a flock coating.

According to an embodiment of the present disclosure, flocking is adhered to the applying member by a suitable adhesive. The preferred adhesive is an epoxy adhesive.

According to an embodiment, the cosmetic package is of an elongated cylindrical configuration. However, in alternate embodiments, the cosmetic package may be of an elongated square, polygonal configuration, oval, triangular, heart, or any other configuration known in the art.

According to an embodiment, the receptacle and the cap may be made of a rigid material like glass, metal, hard plastic or any other material known in the art. However, in alternate embodiments, the receptacle and the closure may be made of a flexible material like flexible polymeric material or any other material known in the art.

According to an embodiment of the present disclosure, the applicator head and the stem are fitted together by a snap fitment. However in alternate embodiments, the applicator head and the stem may be fit together by friction fit, by gluing, crimping, magnetic engagement and the like.

According to an embodiment of the present disclosure, the stem can have a longitudinal axis that is rectilinear as shown. However, in alternate embodiments, it could be curved.

According to an embodiment of the present disclosure, the stem presents a cross-section that is circular, but it is not beyond the ambit of the present disclosure for this to be otherwise, in particular when the cross-section of the stem is oval, elliptical or polygonal, e.g. square, triangular or rectangular. The stem can be solid as shown, or, in a variant, it could be hollow.

When the stem is not of circular cross-section, the cap can possibly be fastened on the receptacle by snap-fastening or by some other means, without turning relative to said receptacle. The wiper can thus present a non-circular wiper orifice of section that is complementary to the section of the stem.

According to an embodiment of the present disclosure, the applicator head can be made, at least in part, from a material that is more flexible than a material from which the stem is made.

According to an embodiment of the present disclosure, at least a part and preferably all of the applicator head can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

While the foregoing is directed to embodiments of the present disclosure, other and further embodiments of the disclosure may be devised without departing from the basic scope thereof, and the scope thereof is determined by the claims that follow.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes described herein. As another example, the materials used for various components can be different from those mentioned specifically herein.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

FIG. 3 illustrates an exploded view of a cosmetic applicator of the cosmetic package of FIG. 2;

Figure 1:
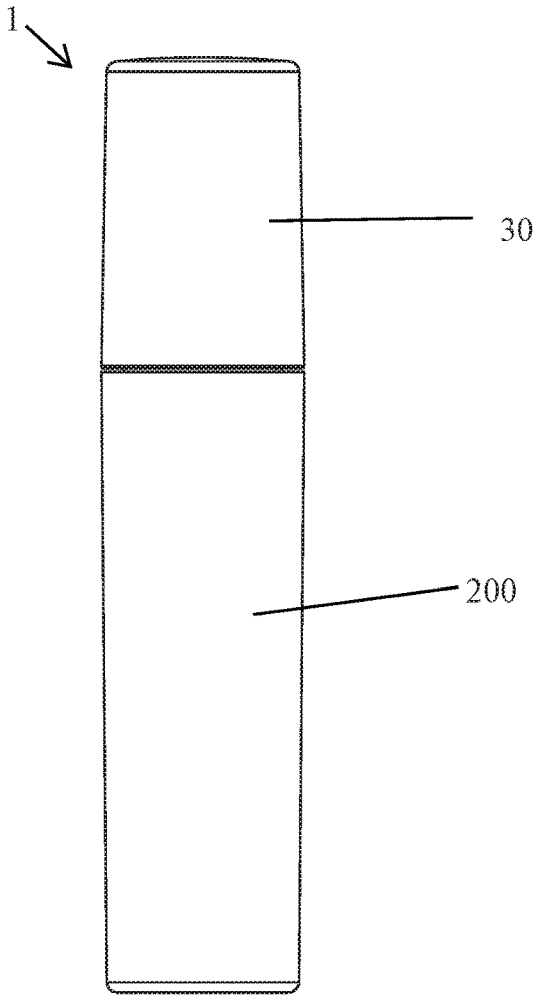
FIG. 1 illustrates a front view of a cosmetic package in a closed position according to an embodiment of the present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Throughout this specification, the terms "comprise," "comprises," "comprising" and the like, shall consistently mean that a collection of objects is not limited to those objects specifically recited.

Figure 2:
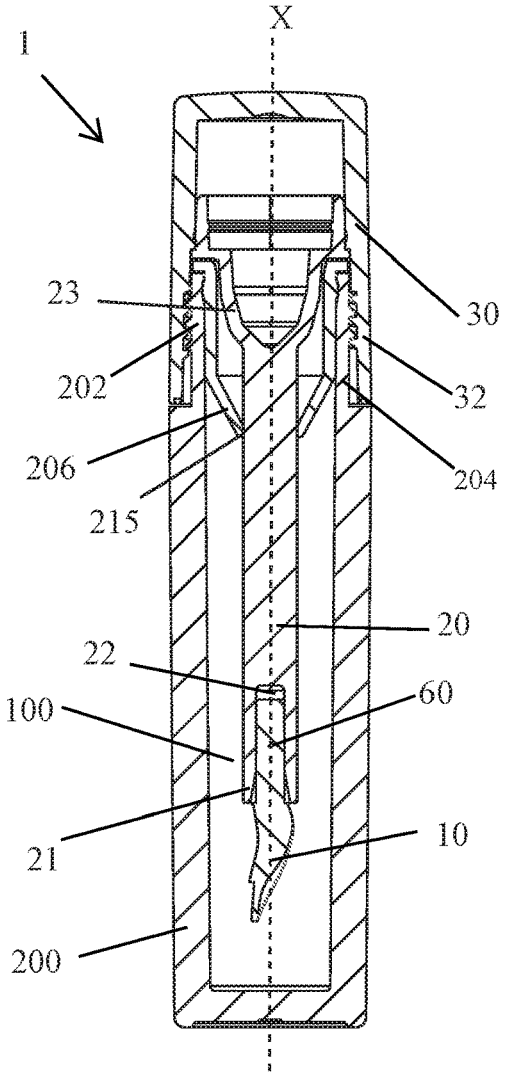
FIG. 2 illustrates a cross-sectional view of the cosmetic package of FIG. 1.

FIG. 1 illustrates a front view of a cosmetic package 1 in a closed position and FIG. 2 illustrates a longitudinal sectional view of the cosmetic package 1. The cosmetic package 1 comprises a receptacle 200 for holding a product (not shown) and a cosmetic applicator 100. The cosmetic applicator 100 comprises an applicator head 10, a stem 20, and a cap 30. The cap 30 of the cosmetic applicator 100 has threads 32 which can be screwed onto threads 202, formed on a neck 204 of the receptacle 200. The applicator head 10 retained at a distal end 21 of the stem 20 for applying the product; and the cap 30 at a proximal end of the stem 20.

In general, the use of the terms "distal" and "proximal" herein is supposed to mean that the distal side/end is the side/end facing towards the inside of the receptacle 200, whereas the proximal side/end is the side/end facing towards the removal opening of the receptacle 200.

Inserted in the neck 204 of the receptacle 200 is a wiper 206 for wiping off excess product from the cosmetic applicator 100.

Further, the applicator head 10 of the cosmetic applicator 100 may be used to apply the product including a cosmetic or care product. The cosmetic or care product includes viscous cosmetics, mascara, eyebrow powder, lip gloss, hair color, skin care, under eye cosmetics, pharmaceutical and like products.

According to an embodiment and as shown in FIG. 1, the cosmetic package 1 is of an elongated cylindrical configuration. However, in alternate embodiments, the cosmetic package 1 may be of an elongated square, polygonal configuration, oval, triangular, heart, or any other configuration known in the art.

According to an embodiment, the receptacle 200 and the closure 30 may be made of a rigid material like glass, metal, hard plastic or any other material known in the art. However, in alternate embodiments, the receptacle 200 and the closure 30 may be made of a flexible material like flexible polymeric material or any other material known in the art.

According to an embodiment of the present disclosure, the applicator head 10 and the stem 20 are fitted together by a snap fitment. However in alternate embodiments, the applicator head 10 and the stem 20 may be fit together by friction fit, by gluing, crimping, magnetic engagement and the like.

According to an embodiment of the present disclosure, the stem 20 can have a longitudinal axis X that is rectilinear as shown. However, in alternate embodiments, it could be curved.

According to an embodiment of the present disclosure, the stem 20 presents a cross-section that is circular, but it is not beyond the ambit of the present disclosure for this to be otherwise, in particular when the cross-section of the stem 20 is oval, elliptical or polygonal, e.g. square, triangular or rectangular. The stem 20 can be solid as shown, or, in a variant, it could be hollow.

When the stem 20 is not of circular cross-section, the cap 30 can possibly be fastened on the receptacle 200 by snap-fastening or by some other means, without turning relative to said receptacle 200. The wiper 206 can thus present a non-circular wiper orifice 215 of section that is complementary to the section of the stem 20.

According to an embodiment of the present disclosure, the applicator head 10 can be made, at least in part, from a material that is more flexible than a material from which the stem 20 is made.

According to an embodiment of the present disclosure, at least a part and preferably all of the applicator head 10 can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

As shown in FIGS. 2 and 3, the applicator head 10 comprises an applying member 40 and a shank portion 60. The shank portion 60 retained at the distal end 21 of the stem 20 for applying the cosmetic product; and the closure 30 is retained at the proximal end 23 of the stem 20. The distal end 21 of the stem 20 includes an interior longitudinal cavity 22 for receiving and retaining the applicator head 10.

Figure 11:
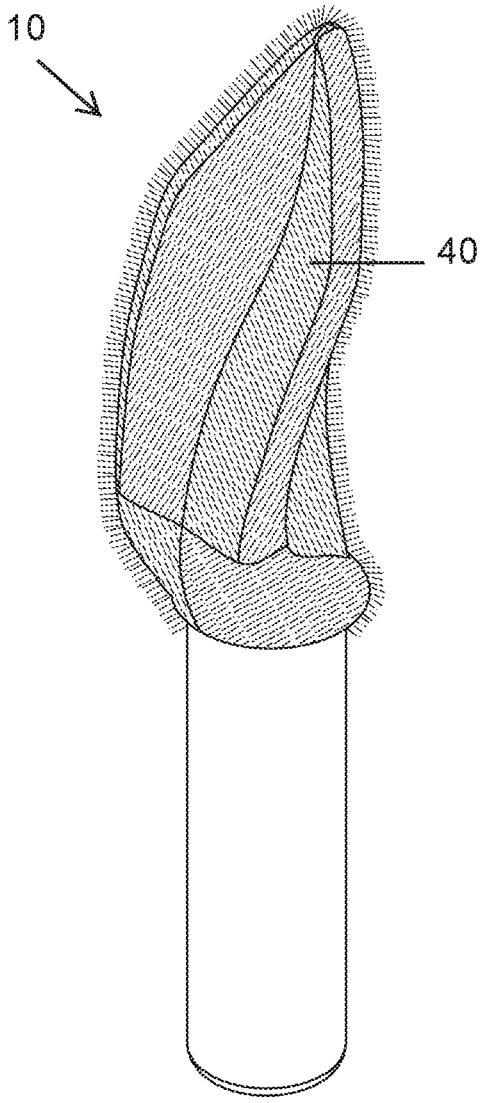
FIG. 11 illustrates a perspective view of the applicator head of FIG. 4 with flocking on an applying member of the applicator head.

According to an embodiment of the present disclosure, an outer surface of the applying member 40 is covered with application element which in this case is flocked fibers, refer FIG. 11. Briefly, the fibers for flocking which may be of any commonly used material, such as nylon, polyester or any natural fiber are applied with an adhesive, such as an epoxy, to the surface to be flocked. The flocking finish to the outer surface of the applying member 40 may be achieved by an appropriately chosen known technique, such as electrostatic flocking. The outer surface of the applying member 40 before being flocked is smooth on its entire surface. That is, the outer surface of the applying member 40 before being flocked has no surface textures, such as a wrinkle finish or a matte finish, over the entire surface thereof. To put it another way, the outer surface of the applying member 40 before being flocked are smooth and slippery. Preferably, the flocking process takes place in an electrostatic field, which results in the proper orientation of the fibers. The flock on the outer surface of the applying member 40 provides a convenient "reservoir" which can hold a small amount of the cosmetic product adequate for one or two applications. In alternate embodiments, the outer of the applying member 40 may include injection molded fibers, projections or grooves which are capable of holding the cosmetic product.

According to an embodiment of the present disclosure, the outer surface of the applying member 40 is covered by a flock coating. However in alternate embodiments, the outer surface of the applying member 40 may not be covered by a flock coating.

According to an embodiment of the present disclosure, flocking is adhered to the applying member 40 by a suitable adhesive. The preferred adhesive is an epoxy adhesive.

According to an embodiment of the present disclosure, central longitudinal axes of the applicator head 10, the applying member 40 and the stem 20 are same as they extend in the same central longitudinal axis X. However, in alternate embodiments, central longitudinal axes of the applicator head 10, the applying member 40 and the stem 20 may not be the same.

Figure 4:
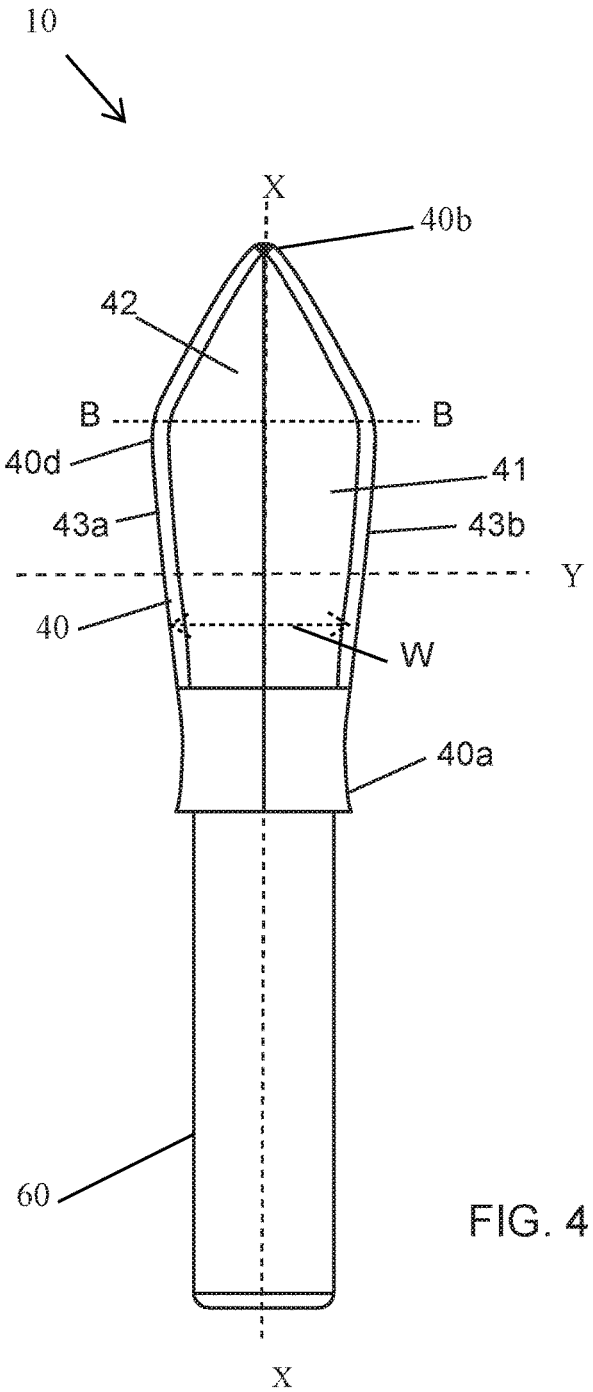
FIG. 4 illustrates a front view of an applicator head of the cosmetic applicator of FIG. 3.

As shown in FIG. 4, the applying member 40 further comprises a support body 41 extending along the longitudinal axis X of the applicator head 10 (refer FIG. 2). The applying member 40 has a longitudinal shape in a direction of the longitudinal axis X in which the stem 20 extends, and has a width axis Y in a direction orthogonal to the central longitudinal axis X. Furthermore, the support body 41 of the applying member 40 is curved along the central longitudinal axis X of the cosmetic applicator 100 (refer FIGS. 5 and 6).

The support body 41 of the applying member 40 further comprises a first application face 42 and a second application face 44 (refer FIG. 7) which opposes the first application face 42. The first application face 42 and the second application face are bounded by two lateral edges 43*a*, 43*b*. The support body 41 of the applying member 40 comprises a recessed region 42*c* formed at a distal portion 40*c* of the first application face 42 and a hollow region 44*c* formed at a proximal portion 40*d* of the second application face 44. The distal portion 40*c* of the applying member 40 is inclined with respect to the central longitudinal axis X of the applicator head 10, refer FIG. 6.

Figure 5:
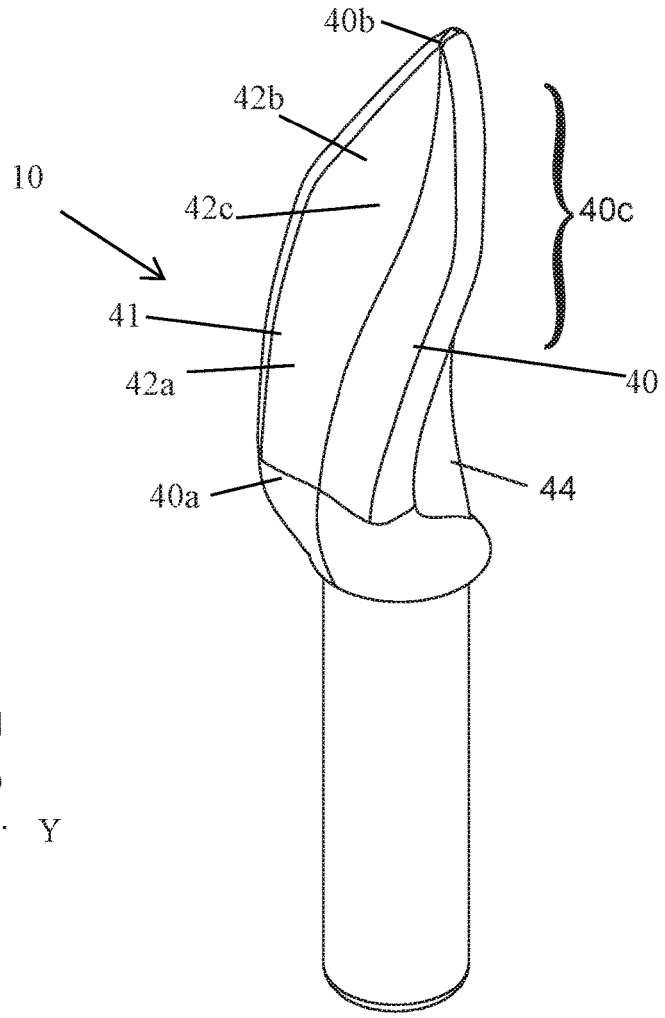
FIG. 5 illustrates a front perspective view of the applicator head of FIG. 4.
Figure 6:
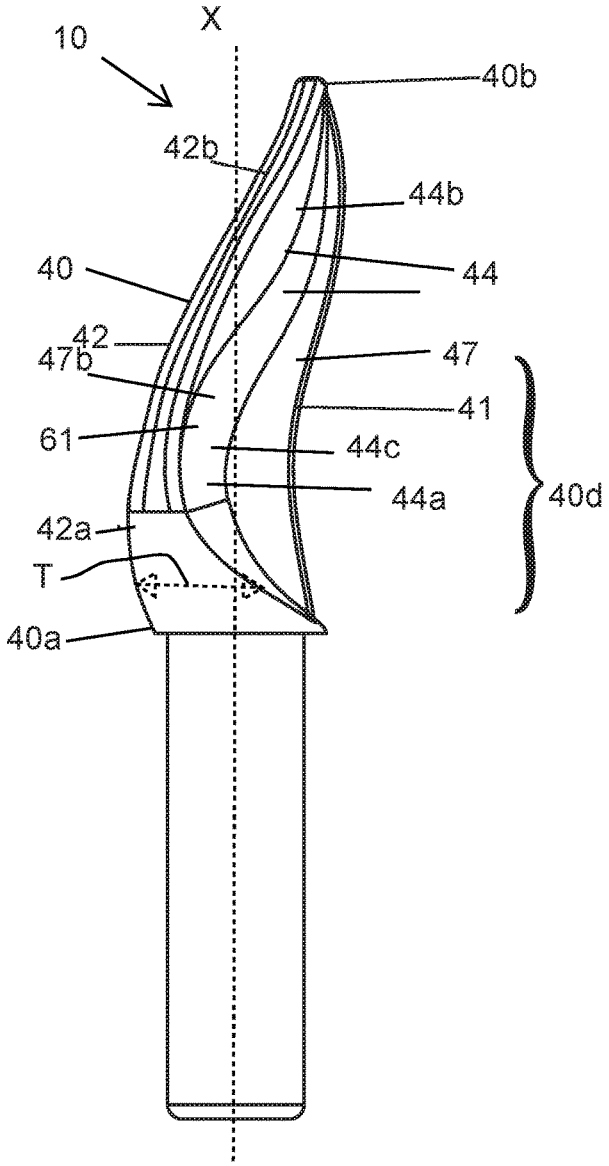
FIG. 6 illustrates a side view of the applicator head of FIG. 4.

Referring to FIGS. 5 and 6, the first application face 42 has a convex surface 42*a* followed by a concave surface 42*b* when seen from a proximal end 40*a* to a distal end 40*b* of the applying member 40 along the central longitudinal axis X.

Further, as shown in FIGS. 5 and 6, the convex surface 42*a* of the first application face 42 extends along at least 30% of a length of the first application face 42 of the applying member 40, more preferably at least 50% of the length of the first application face 42 of the applying member 40. However, in alternate embodiments, the convex surface 42*a* may extend along less or more than half of the length of the first application face 42 of the applying member 40.

Figure 10:
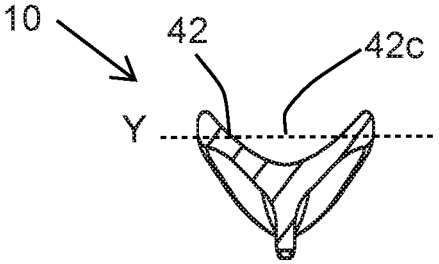
FIG. 10 illustrates a cross-sectional view taken along a line B-B of the applicator head of FIG. 4.

The first application face 42 is provided with the recessed region 42*c* which is curved along the width axis Y, refer FIGS. 5 and 10. The recessed region 42*c* extends in the concave surface 42*b* and partially on the convex surface 42*a* of the first application face 42. A width of the recessed region 42*c* varies along the central longitudinal axis X. Thus, a proximal part of the convex surface 42*a* is convexly curved both in the central longitudinal axis X and in the width axis Y, but a distal portion of the convex surface 42*a* is convexly curved in the central longitudinal axis X but is concavely curved in the width axis Y due to presence of the recessed region 42*c* which extends partially therein.

Further, the recessed region 42*c* is configured to hold a large amount of cosmetic product. When the cosmetic applicator 100 is used, the cosmetic product is held in the recessed region 42*c*. The recessed region 42*c* extends along at least 50% of the length of the first application face 42. However, in alternate embodiments, the recessed region 42*c* may extend less or more than 60% of the length of the first application face 42 of the applying member 40.

The convex surface 42*a* of the first application face 42 preferably has a larger radius of curvature than a radius of curvature of the concave surface 42*b* of the first application face 42 in a side view of the applying member 40.

As shown in FIG. 6, the second application face 44 has a concave surface 44*a* followed by a convex surface 44*b* when seen from the proximal end 40*a* to the distal end 40*b* of the applying member 40. Further, the convex surface 42*a* of the first application face 42 opposes the concave surface 44*a* of the second application face 44, and similarly, the concave surface 42*b* of the first application face 42 opposes the convex surface 44*b* of the second application face 44.

The concave surface 44*a* extends along more than 30% of a length of the second application face 44 of the applying member 40, more preferably at least 50% of the length of the second application face 44 of the applying member 40. However, in alternate embodiments, the concave surface 44*a* may extend along more or less than half of the length of the second application face 44 of the applying member 40.

The support body 41 of the applying member 40 has the hollow region 44*c* which is formed by the concave surface 44*a* of the second application face 44. The hollow region 44*c* is configured to hold a large amount of cosmetic product. When the cosmetic applicator 100 is used, the cosmetic product is held in the hollow region 44*c*.

As shown in FIG. 6, the concave surface 44*a* of the second application face 44 preferably has a larger radius of curvature than the convex surface 44*b* of the second application face 44 in a side view of the applying member 40. When the cosmetic product is applied to the lips, the concave surface 44*a* of the second application face 44 uniformly hugs the lips, while providing a sufficient amount of the cosmetic product for application because of the hollow region 44*c*.

Figure 7:
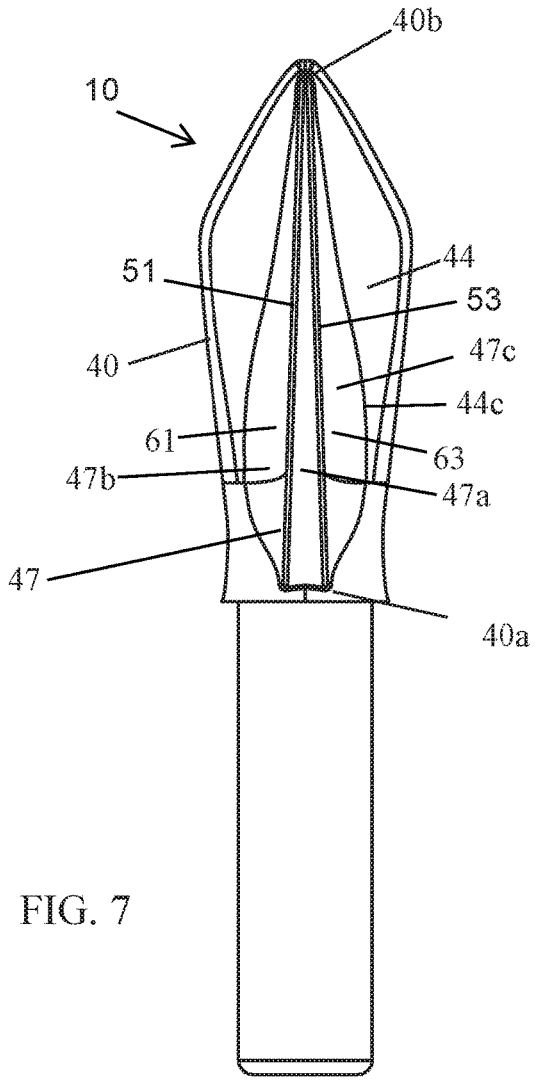
FIG. 7 illustrates a back view of the applicator head of FIG. 4.
Figure 9:
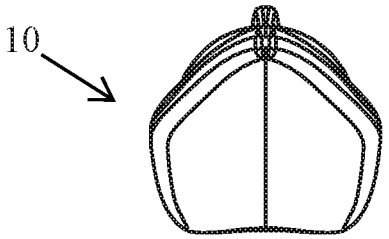
FIG. 9 illustrates a top view of the applicator head of the cosmetic applicator of FIG. 4.

Further as shown in FIGS. 6 and 7, the second application face 44 comprises a longitudinal rib 47 that extends along at least a major portion of the length of the second application face 44 from the proximal end 40*a* to the distal end 40*b* of the applying member 40. The longitudinal rib 47 is molded with the second application face 44 of the applying member 40. More particularly, the longitudinal rib 47 is formed in the central region in the width axis Y and is formed over substantially the entire length in the longitudinal axis X of the applying member 40. The longitudinal rib 47 extends both on the concave surface 44*a* and the convex surface 44*b* of the second application face 44.

The longitudinal rib 47 divides the hollow region 44*c* into two reservoirs, namely a first reservoir 61 and a second reservoir 63. The first reservoir 61 lies on a left side of the longitudinal rib 47 while the second reservoir 63 lies on a right side of the longitudinal rib 47. The first reservoir 61 and the second reservoir 63 are symmetrical with respect to each other.

Further, the longitudinal rib 47 extends up to at least 90% of a length of the applying member 40 on the second application face 44. In alternate embodiments, the longitudinal rib 47 may extend less or more than 90% of the length of the applying member 40 such that it extends both on the concave surface 44*a* and the convex surface 44*b* of the second application face 44.

The longitudinal rib 47 has a width along Y axis which gradually decreases along the longitudinal axis X from the proximal end 40*a* towards the distal end 40*b* of the applying member 40. At the distal end 40*b* of the applying member 40, the longitudinal rib 47 forms a tapered tip.

Figure 8:
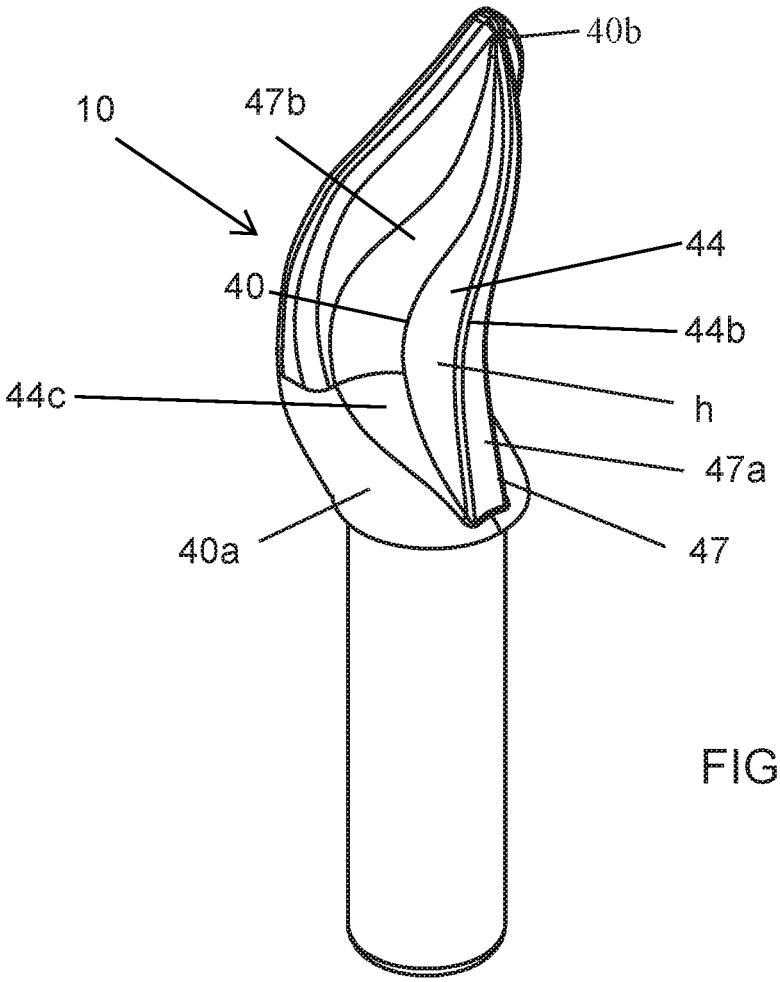
FIG. 8 illustrates a back perspective view of the applicator head of FIG. 4.

As shown in FIG. 8, the longitudinal rib 47 has a height h along the longitudinal axis X that varies. An upper surface 47*a* of the longitudinal rib 47 is curved along the longitudinal axis X and comprises a concave curve followed by a convex curved when seen from the proximal end 40*a* to the distal end 40*b* of the applying member 40.

Further as shown in FIGS. 7 & 8, the longitudinal rib 47 has a substantially mountain shape and has two inclined surfaces 47*b* and 47*c* that extend left and right of the longitudinal rib 47. The inclined surfaces 47*b* and 47*c* are formed along the longitudinal axis X of the longitudinal rib 47 over substantially its entire length. The inclined surfaces 47*b*, 47*c* each has a concave curved surface capable of holding the cosmetic product. The degree of holding the cosmetic product can be controlled by adjusting the degree of concave curvature. In this case, the degree of curvature of the two curved surfaces of the inclined surfaces 47*b* and 47*c* may be the same or different.

The longitudinal rib 47 provides a structural strength to the applying member 40, so that the applying member 40 does not bend away from the longitudinal axis X during wiping by the wiper 206 on withdrawal of the applying member 40 from the receptacle 200. In other words, the longitudinal rib 47 hinders the deformation of the applying member 40 away from the longitudinal axis X.

The longitudinal rib 47 has a first longitudinal edge 51 and a second longitudinal edge 53. The first longitudinal edge 51 and the second longitudinal edge are symmetrical with respect to each other.

The applying member 40 has a widest part 40*d* when viewed from the front or back. The widest part 40*d* may be present at any portion of a length of the applying member 40. As shown in FIG. 4, the applying member 40 has the widest part 40*d* located approximately at ¾th of the length of the applying member 40 near a distal portion of the applying member 40. In alternate embodiment, the widest part 40*d* may not be located at ¾th of the length of the applying member 40.

Referring to FIG. 4, when viewed from the front, from the proximal end 40*a* to the distal end 40*b* of the applying member 40, lateral edges 43*a*, 43*b* of the applying member 40 move away from the central longitudinal axis X till they reach the widest part 40*d* and then converge toward each other to form a pointed tip at the distal end 40*b* forming a pen nib like shape.

The support body 41 of the applying member 40 gradually decreases in a width W from the widest part 40*d* towards the proximal end 40*a* of the applying member 40. Further, the width of the support body 41 of the applying member 40 gradually decreases from the widest part 40*d* to the distal end 40*b* of the applying member 40 forming a tapered tip. The tapered tip is preferably a sharply pointed. The sharply pointed tip helps in delicate and fine application of the cosmetic product to, for example, the ends of lips of the user. In short, the applying member 40 has its width gradually increased from the tapered tip to the widest part 40*d* and gradually decreased from the widest part 40*d* towards the proximal end 40*a*.

Referring to FIG. 6, a thickness T of the applying member 40, measured as smallest distance between the first and the second application faces 42, 44, reduces along the longitudinal axis X at least from the proximal end 40*a* of the applying member up to a middle length of the applying member 40 and is substantially constant from the middle length to upto the distal end 40*b* of the applying member 40. Further, thickness T of the applying member 40 at any point along its length is maximum at a middle of the applying member 40, see FIG. 10.

In alternate embodiments, the thickness T of the applying member 40 may remain constant through the length of the applying member 40 or may vary at least at any portion of the length of the applying member 40.

In applying the cosmetic product, the applying member 40 is able to retain an increased quantity of the cosmetic product because of the synergistic effect brought about by the combination of the curvedness and the effect of the flocking finish. As a result, the number of the applying operations is reduced. To cover the applying portion in flocking produces another advantage that the applying portion feels soft when applied to the lips or any other area of skin of the user.

While the foregoing is directed to embodiments of the present disclosure, other and further embodiments of the disclosure may be devised without departing from the basic scope thereof, and the scope thereof is determined by the claims that follow.

What is claimed is:

1. A cosmetic applicator for applying a cosmetic or a care product, the cosmetic applicator comprising:

an applicator head;

a stem;

and a cap;

wherein the applicator head is retained at a distal end of the stem, and comprising a central longitudinal axis;

wherein the cap is retained at a proximal end of the stem;

wherein the applicator head comprises an applying member and a shank portion;

wherein the shank portion is formed at a proximal portion of the applicator head;

wherein the applying member is formed at a distal portion of the applicator head;

wherein the applying member comprises a support body extending in along the central longitudinal axis;

wherein the support body is curved along the central longitudinal axis of the applicator head;

wherein the support body of the applying member comprises a first application face and a second application face opposing the first application face;

wherein the first application face and a second application face are bounded by two lateral edges;

wherein the support body of the applying member comprises a recessed region formed at a distal portion of the first application face and a hollow region formed at a proximal portion of the second application face;

wherein the recessed region at the first application face is concavely curved in a width direction orthogonal to the central longitudinal axis of the applicator head;

wherein the hollow region at the second application face is concavely curved in a longitudinal direction parallel to the central longitudinal axis of the applicator head;

wherein the recessed region extends along at least 50% of a length the applying member on the first application face;

wherein the hollow region extends along at least 50% of the length of the applying member on the second application face;

wherein a longitudinal rib extends on the second application face along the central longitudinal axis of the applying member from a proximal end of the applying member to up to a portion of the length of the applying member;

wherein the longitudinal rib divides the hollow region on the second application face into a first reservoir and a second reservoir; and wherein the first reservoir lies on a left side of the longitudinal rib and the second reservoir lies on a right side of the longitudinal rib.

2. A cosmetic applicator according to claim 1, wherein the support body of the applying member is flat along at least a distal portion of the applying member.

3. A cosmetic applicator according to claim 1, wherein the first application face of the applying member has a convex surface followed by a concave surface when seen from the proximal end to a distal end of the applying member along the central longitudinal axis, and wherein the second application face of the applying member has a concave surface followed by a convex surface when seen from the proximal end to the distal end of the applying member along the central longitudinal axis.

4. A cosmetic applicator according to claim 3, wherein the convex surface of the first application face extends along at least 30% of a length of the first application face of the applying member, and wherein the concave surface of second application face extends along more than 30% of a length of the second application face of the applying member.

5. A cosmetic applicator according to claim 3, wherein a proximal portion of the convex surface of the first application face is convexly curved both in a longitudinal direction and in the width direction, and wherein a distal portion of the convex surface of the first application face is convexly curved in the longitudinal direction and is concavely curved in the width direction due to presence of the recessed region; and wherein the recessed region extends in the concave surface of the first application face and partially in the convex surface of the first application surface of the applying member.

6. A cosmetic applicator according to claim 3, wherein the convex surface of the first application face opposes the concave surface of the second application face, and similarly, the concave surface of the first application face opposes the convex surface of the second application face.

7. A cosmetic applicator according to claim 3, wherein the concave surface of the second application face creates the hollow region on the second application face.

8. A cosmetic applicator according to claim 3, wherein the concave surface of the second application face has a larger radius of curvature than a radius of curvature of the convex surface of the second application face, and wherein the convex surface of the first application face has a larger radius of curvature than a radius of curvature of the concave surface of the first application face.

9. A cosmetic applicator according to claim 3, wherein the longitudinal rib extends both on the concave surface and the convex surface of the second application face.

10. A cosmetic applicator according to claim 9, wherein the longitudinal rib has a width which gradually decreases along the central longitudinal axis from the proximal end of the applying member towards the distal end of the applying member.

11. A cosmetic applicator according to claim 1, wherein a width of the recessed region varies along the central longitudinal axis of the applicator head.

12. A cosmetic applicator according to claim 1, wherein the longitudinal rib has a height that varies along the central longitudinal axis; and wherein an upper surface of the longitudinal rib is curved along the central longitudinal axis and comprises a concave curve followed by a convex curve when seen from the proximal end to a distal end of the applying member.

13. A cosmetic applicator according to claim 1, wherein the applying member comprises two inclined surfaces that extend left and right of the longitudinal rib on the second application face, and wherein the inclined surfaces are formed along a longitudinal direction of the longitudinal rib over the entire length of the longitudinal rib.

14. A cosmetic applicator according to claim 1, wherein when seen from the proximal end to a distal end of the applying member, the lateral edges of the applying member move away from the central longitudinal axis till they reach a widest part of the applying member and then converge toward each other to form a pointed tip at the distal end of the applying member.

15. A cosmetic applicator according to claim 14, wherein the widest part is located approximately at ¾th of the length of the applying member near the distal portion of the applying member.

16. A cosmetic applicator according to claim 15, wherein a width of the applying member gradually decreases from the widest part towards the proximal end of the applying member, and the width of the applying member gradually decreases from the widest part to the distal end of the applying member forming a tapered tip at the distal end.

17. A cosmetic applicator according to claim 1, wherein a thickness of the applying member reduces from the proximal end of the applying member up to a middle length of the applying member and is substantially constant from the middle length to up to a distal end of the applying member.

18. A cosmetic applicator according to claim 17, wherein the thickness of the applying member at any point along its length is maximum at a middle of the applying member.

19. A cosmetic applicator according to claim 1, wherein the distal portion of the applying member is inclined with respect to the central longitudinal axis, and wherein a tip formed at a distal end of the applying member is off-centered with respect to the central longitudinal axis of the applying member.

20. A cosmetic applicator for applying a cosmetic or a care product, the cosmetic applicator comprising:

an applicator head retained at a distal end of a stem, and comprising a central longitudinal axis;

a shank portion is defined at a distal portion of the applicator head;

an applying member is formed at a proximal portion of the applicator head;

wherein the applying member extends along the central longitudinal axis and is curved along the central longitudinal axis of the applicator head;

wherein the applying member comprises a first application face and a second application face opposing the first application surface;

wherein the first application face of the applying member has a convex surface followed by a concave surface when seen from a proximal end to a distal end of the applying member along the central longitudinal axis;

wherein the second application face of the applying member has a concave surface followed by a convex surface when seen from the proximal end to the distal end of the applying member along the central longitudinal axis;

wherein the first application face of the applying member comprises a recessed region which extends majorly on the concave surface and slightly on the convex surface of the first application face;

wherein the recessed region on the first application face is concavely curved in a width direction orthogonal to the central longitudinal axis of the applicator head;

wherein a hollow region is formed at the concave surface of the second application face;

wherein the hollow region at the second application face is concavely curved in a longitudinal direction parallel to the central longitudinal axis of the applicator head;

wherein a longitudinal rib extends on the second application face along the central longitudinal axis of the applying member from the proximal end of the applying member to up to a portion of a length of the applying member such that the longitudinal rib extends both on the concave surface and the convex surface of the second application face;

wherein the longitudinal rib divides the hollow region on the second application face into a first reservoir and a second reservoir; and wherein the first reservoir lies on a left side of the longitudinal rib and the second reservoir lies on a right side of the longitudinal rib.

* * * * *